US006668916B2

(12) United States Patent
Zobel et al.

(10) Patent No.: US 6,668,916 B2
(45) Date of Patent: Dec. 30, 2003

(54) FLAT TUBE BLOCK HEAT EXCHANGER

(75) Inventors: Wemer Zobel, Boblingen (DE); Jorg Soldner, Ehningen (DE); Herbert Marschner, Goppingen (DE); Harald Schatz, Reutlingen (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/252,626

(22) Filed: Sep. 23, 2002

(65) Prior Publication Data

US 2003/0056945 A1 Mar. 27, 2003

(30) Foreign Application Priority Data

Sep. 25, 2001 (DE) ..... 101 47 192

(51) Int. Cl.[7] ..... F28D 7/06

(52) U.S. Cl. ..... 165/176; 165/173; 165/177; 29/890.053

(58) Field of Search ..... 165/173, 175, 165/176, 148; 29/890.052, 890.053

(56) References Cited

U.S. PATENT DOCUMENTS

| | | | | |
|---|---|---|---|---|
| 1,440,139 A | * | 12/1922 | Dippert | 165/175 |
| 3,016,230 A | | 1/1962 | Cederstrom et al. | |
| 3,021,804 A | * | 2/1962 | Simpelaar | 165/176 |
| 3,265,126 A | | 8/1966 | Donaldson | |
| 4,313,494 A | | 2/1982 | Bengtsson | |
| 5,186,250 A | | 2/1993 | Ouchi et al. | |
| 5,457,885 A | | 10/1995 | Ohashi et al. | |
| 5,762,133 A | * | 6/1998 | Dion | 165/176 |
| 6,012,512 A | | 1/2000 | Ghiani | |
| 6,044,554 A | | 4/2000 | Potier | |
| 6,068,050 A | | 5/2000 | Ghiani | |
| 6,311,768 B1 | | 11/2001 | Jamison et al. | |
| 6,397,937 B1 | * | 6/2002 | Ghiani | 165/173 |
| 6,513,585 B2 | * | 2/2003 | Brost et al. | 165/175 |
| 2001/0037878 A1 | | 11/2001 | Brost et al. | |
| 2001/0047863 A1 | | 12/2001 | Brost et al. | |
| 2002/0108742 A1 | * | 8/2002 | Lamich et al. | 165/175 |

FOREIGN PATENT DOCUMENTS

| | | |
|---|---|---|
| CH | 378353 | 7/1964 |
| DE | 1 519 204 | 6/1942 |
| DE | 1451 258 | 3/1969 |
| DE | 1551 448 | 2/1972 |
| DE | 37 25 602 A1 | 2/1989 |
| DE | 38 34 822 A1 | 4/1990 |
| DE | 195 10 283 A1 | 9/1996 |
| DE | 195 43 986 A1 | 5/1997 |
| DE | 197 22 099 A1 | 9/1998 |
| DE | 197 22 097 A1 | 12/1998 |
| DE | 198 20 937 A1 | 11/1999 |

* cited by examiner

*Primary Examiner*—Terrell McKinnon
(74) *Attorney, Agent, or Firm*—Wood, Phillips, Katz, Clark & Mortimer

(57) ABSTRACT

A flat tube block heat exchanger with a plurality of flat tubes with deformed ends. The deformed ends have broad sides that have been deformed to expose the inner surface of the flat tubes. The exposed inner surfaces of the flat tubes are bonded to the exposed inner surface of an adjacent flat tube. The bonded inner surfaces of the adjacent flat tubes form a fluid barrier with tanks located at opposite ends of the flat tubes.

17 Claims, 8 Drawing Sheets

29
16

29
22
16
42

22
20
41
43
41
20
42

40
20b
29
20a
42

20b
29
20a
28
28
42

32
40
20b
29
20a
32
28
28
42

32
24
28
29
32
28
42

32
28
16
40
29
32
28
42

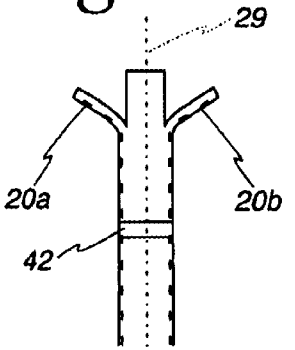
Fig. 9A
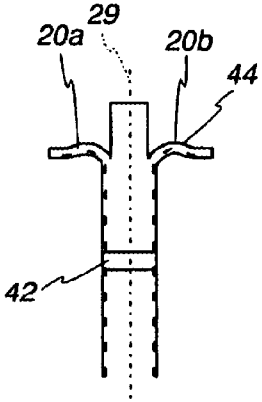
Fig. 9B
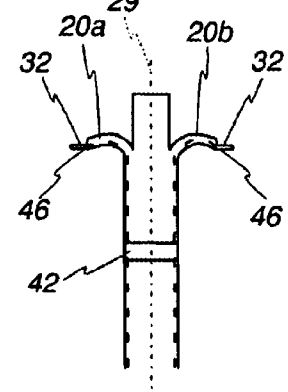
Fig. 9C
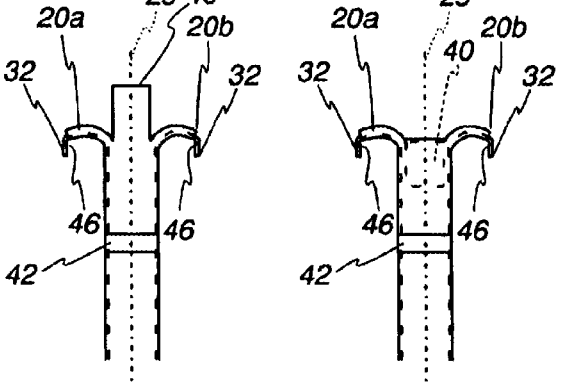
Fig. 9D
Fig. 9E
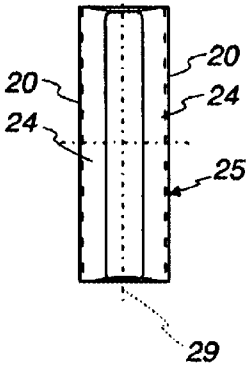
Fig. 11
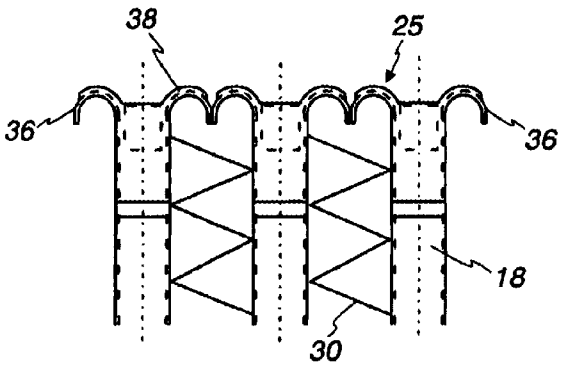
Fig. 10

FLAT TUBE BLOCK HEAT EXCHANGER

FOREIGN PRIORITY

This application claims priority to DE 101 47 192.0, a German patent application filed Sep. 25, 2001, pursuant to 35 U.S.C. §119(a)–(d).

FIELD OF THE INVENTION

This invention pertains to heat exchangers for vehicles and more particularly to such heat exchangers that include a block of heat exchange elements including flat tubes.

BACKGROUND OF THE INVENTION

Flat tube block heat exchangers have rows of flat tubes that may be alternated with corrugated fins. The ends of the flat tubes provide flow paths between tanks located at the opposite ends of the flat tubes and the flat tubes extend from one header plate to another header plate at the opposite end of the flat tubes. Typically, the flow paths created by the flat tubes extend generally perpendicular to the header plates at the ends of the tubes. The header plates are manufactured and supplied separately from the flat tubes and are typically made from relatively heavy materials. Further, the header plates occupy space at the collection tanks located at either end of the flat tube block heat exchanger.

Headerless flat tubes have been formed by placing two tube halves adjacent to one another where the ends of the tube halves have been deformed such that the broad sides may be connected. Drawn or welded tubes have been slit in their narrow sides in order to deform the ends and connect the broad sides. In both cases the connected broad sides form a "peak-and-valley" surface that is not conducive to directing flow from a transverse direction into the flat tubes. Examples of heat exchangers with these types of flat tubes are disclosed in German Patent Application Nos. DE 100 16 113.8 and DE 100 19 268.8, both of which are incorporated herein by reference.

While these constructions can perform satisfactory for their intended purpose, there is always room for improvement. For example, the pressure loss of the medium flowing through the collection tanks and flat tubes of a block heat exchanger could be reduced in order to improve their application opportunities, especially in the vehicle field.

BRIEF SUMMARY OF THE INVENTION

In one form, the invention provides a heat exchanger that includes a pair of collection tanks spaced opposite each other. The tanks are fluidly connected by a plurality of flat tubes that provide flow paths between the tanks. The flat tubes have opposing ends that correspond to one of the tanks and each end has two broad sides and two narrow sides. Each broad side has an inner surface and is deformed to expose the inner surface. The exposed inner surfaces of each flat tube are bonded to the exposed inner surface of any adjacent flat tube to define a fluid barrier with the corresponding tank.

In one form, each of the narrow sides is connected to an edge of the corresponding tank.

According to one form, the deformed broad sides have two bends of about 90° with the bonded inner surfaces arranged in parallel orientation to the broad sides of any adjacent flat tube. Alternatively, the flat tubes are arranged in oblique orientation relative to a longitudinal axis of the flat tubes and the broad sides have a first bend of about 90° and a second bend that corresponds to the angle of the oblique orientation. In another alternative, the deformed broad sides are curved to expose the inner surface with a cross-section that is semicircular or semielliptical.

According to one form, the bonded broad sides define a plurality of fluid inflow funnels to the flat tubes.

According to one form, the flat tubes are formed from two half-shells.

In one form, each of the narrow sides includes a cut extending parallel to a longitudinal axis of the flat tubes, the cut separates the broad sides at the tube end.

In one form, each of the narrow sides includes two cuts that separate the broad sides at the tube ends and define a tab in each narrow side. In one form, the tab is bent inward into the flat tube.

In yet another form of the invention, a heat exchanger includes a pair of tanks spaced opposite each other, the tanks are fluidly connected by a plurality of spaced apart flat tubes to provide flow paths between the tanks. Each flat tube has opposing ends corresponding to one of the tanks, each end has a first broad side, a second broad side, and two narrow sides, each broad side has an inner surface and an outer surface. Each first broad side being deformed to expose the inner surface of the first broad side, and each of the exposed inner surfaces of each first broad side is bonded to the outer surface of any adjacent second broad side to define a fluid barrier with corresponding tank.

In another form, the invention provides a method for manufacturing a heat exchanger includes the steps of: cutting a plurality of flat tube ends to separate each tube end into a pair of broad sides; deforming each of the broad sides to expose an inner surface of the broad side; abutting the exposed inner surface of each of the broad sides to an exposed inner surface of an adjacent broad side of another tube; affixing a tank on the flat tube ends; and bonding the adjacent broad sides to each other and the flat tube ends to the tanks.

In one form, each flat tube end includes a pair of narrow sides in the flat tube end, and the bonding step includes bonding the narrow sides of the flat tube ends to the tank.

In yet another form, a method is provided for manufacturing a heat exchanger and includes the steps of: cutting a plurality of flat tube ends to separate each tube end into a pair of broad sides; deforming each of the broad sides to expose an inner surface of the broad side; abutting the exposed inner surface of one of the broad sides to an outer surface of an adjacent broad side; affixing a tank on the flat tube ends; and bonding the adjacent broad sides to each other and the flat tubes with the tanks.

In one form, each flat tube end includes a pair of narrow sides in the flat tube end and the bonding step includes bonding the narrow ends of the flat tube ends to the tank.

Objects and advantages of the invention, as well as additional inventive features, will be apparent from the description of the invention provided herein and in the associated figures and appended claims.

BRIEF DESCRIPTION OF THE DRAWINGS

FIGS. 9A–9E are schematic depictions of another flat tube end deformation process.

FIG. 10 is a cross-sectional view of a row of bonded flat tubes deformed by the process depicted in FIGS. 9A–9E.

FIG. 11 is a top view of an individual flat tube.

DETAILED DESCRIPTION OF THE INVENTION

Figure 1:
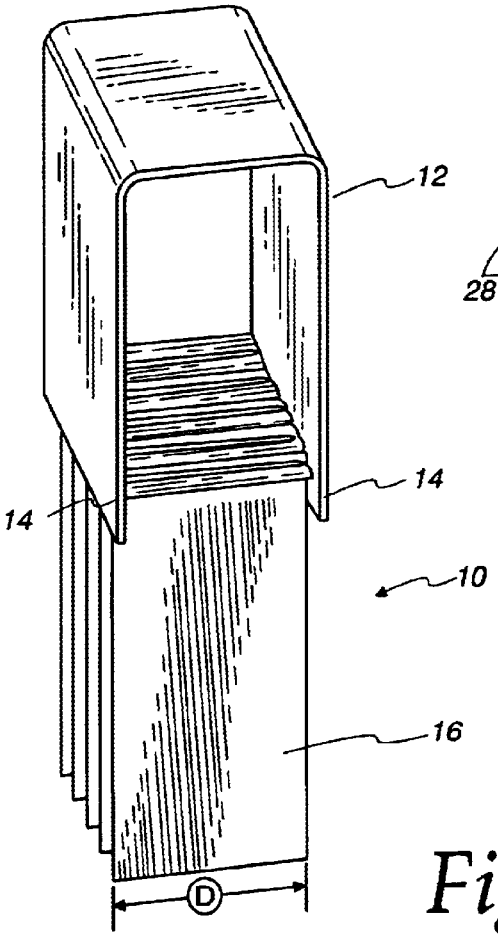
FIG. 1 is a perspective view of a heat exchanger embodying the invention.
Figure 2:
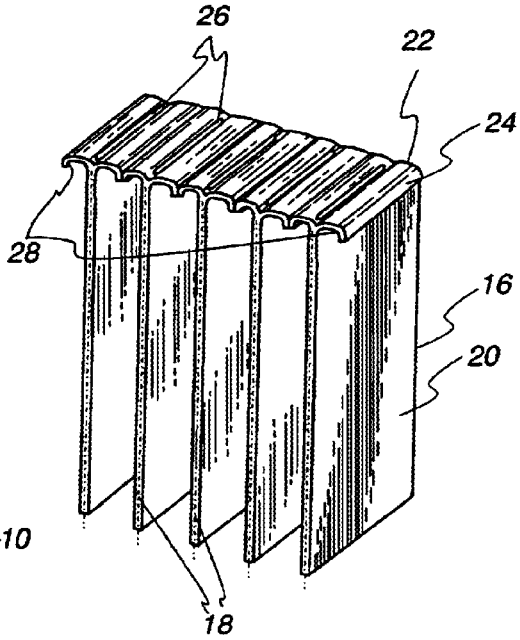
FIG. 2 is perspective view of a row of bonded flat tubes embodying the present invention.
Figure 3:
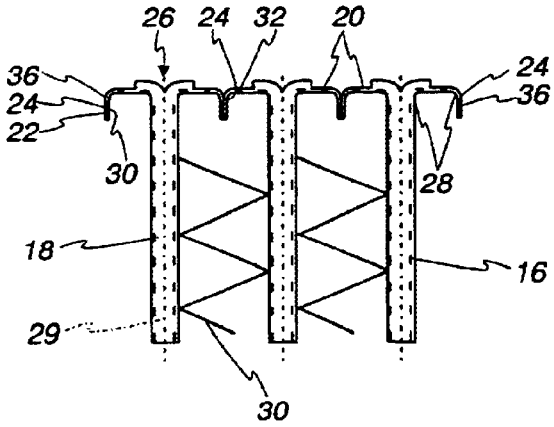
FIG. 3 is a side elevation of a row of bonded flat tubes embodying the present invention.

A heat exchanger 10 embodying the present invention is represented in FIG. 1 and depicts a collection tank 12 with side walls 14 that contact a row of flat tubes 16. A second tank (not shown) contacts the row of flat tubes 16 opposite the collection tank 12. The flat tubes 16 may be formed by welding, soldering or brazing two half shells together, or the flat tubes 16 may be drawn or extruded. As best seen in FIG. 3, heat exchange elements, such as corrugated ribs or serpentine fins 30 are preferably placed between rows of flat tubes 16.

Each of the flat tubes 16 has narrow sides 18 and broad sides 20. The ends 22 of the flat tubes 16 are deformed to expose an inner surface 24 of each broad side 20. As best seen in FIG. 3, in one form the deformed flat tubes 16 are held together by bonding the inner surface 24 of one broad side 20 to the inner surface 24 of the broad side 20 of an adjacent flat tube 16. The bonded flat tubes 16 define a fluid barrier with the corresponding tank 12 that can eliminate the need for a separate header plate on the tank 12. The deformed ends 22 define a relatively flat surface 25 and fluid inflow funnels 26 that provide a fluid inlet to the flat tubes 16. The flat surface can reduce pressure loses in comparison to the "peak and valley" configurations discussed in the Background section. Preferably, the narrow sides 18 of the flat tubes 16 are bonded to the edges 14 of the tanks 12. Any suitable bonding technique, such as brazing, soldering, or welding, can be employed for any of the bonded connections or joints mentioned herein. The collection tank 12 may be closed on the ends transversing the tube ends 22 by several means well known in the art.

As seen in FIGS. 2–6 and 8, in some embodiments the broad sides 20 of the flat tubes ends 22 are deformed into two bends 28 of about 90° with the bonded inner surfaces 24 arranged roughly in parallel orientation to the broad sides 20 of any adjacent flat tube 16. Alternatively, the inner surfaces 24 of the flat tubes 16 are arranged in an oblique orientation relative to the longitudinal axis 29 of the flat tubes 16 and the broad sides 20 have a first bend of about 90° and a second bend corresponding to the angle of the oblique orientation.

In the embodiment depicted in FIG. 3, a section of each of the narrow sides 18 has been removed or reshaped such that each broad side 20 has an narrowed end 32 with little or no corresponding narrow side 18. Each narrowed end 32 has a portion 36 of the exposed inner surface 24 that is bonded to the portion 36 of the broad side 20 of an adjacent flat tube 16.

Figure 4:
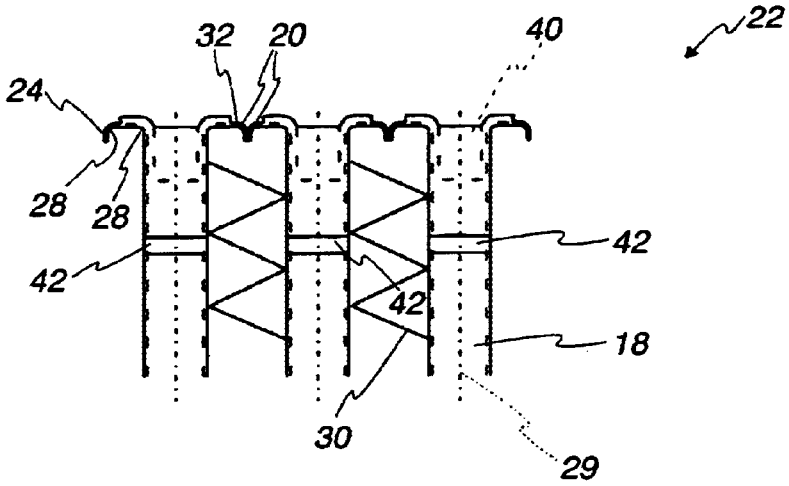
FIG. 4 is a side elevation of a row of bonded flat tubes embodying the present invention.
Figure 5:
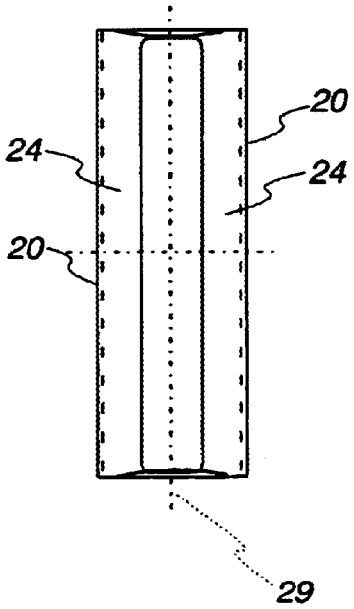
FIG. 5 is a top view of an individual flat tube.
Figures 6A, 6B, 6C, 6D, 6E, 6F, 6G, 6H:
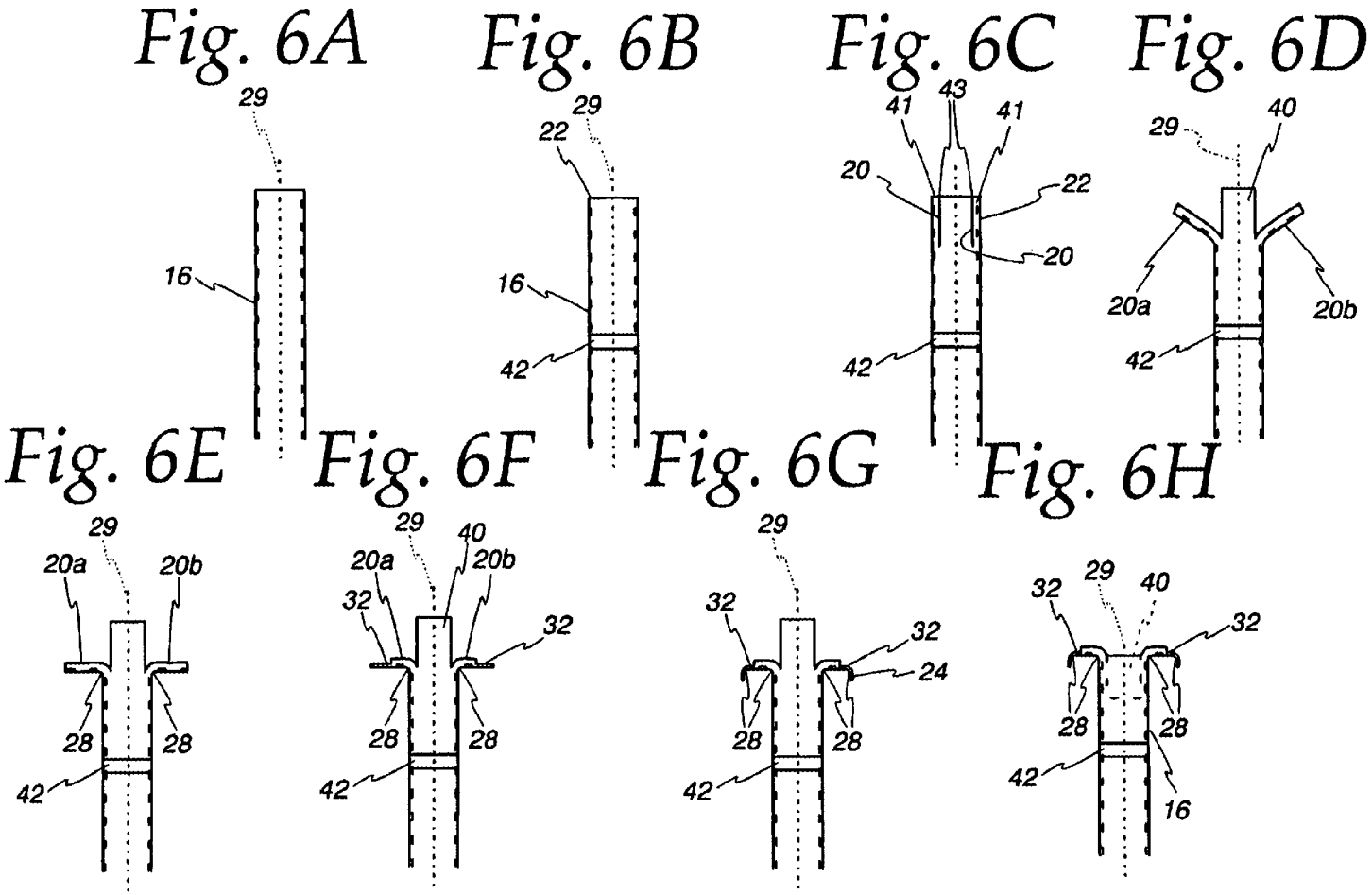
FIGS. 6A–6H are schematic depictions of the steps of a deformation process embodying the present invention.
Figure 7A:
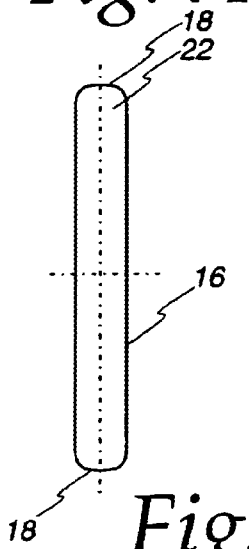
FIGS. 7A–7C are schematic depictions of a process to form a rectangular cross-section of the flat tube end.
Figure 7B:
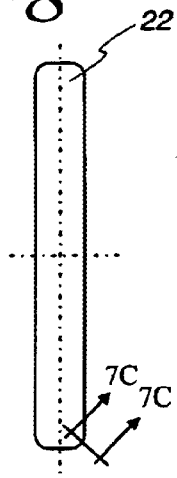
Figure 7C:
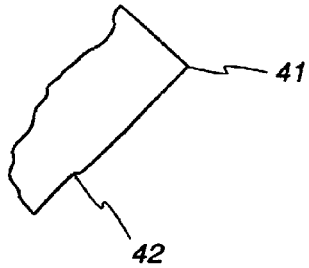

In another embodiment, the tube ends 22 of FIG. 4 include tabs 40 formed from the narrow sides 18 of the flat tubes 16. The tabs 40 are bent toward the inside of the flat tubes 16 and folded against the inner surface 24. Alternatively, the tabs 40 may be eliminated by pinching or similar deformation. However, when the tabs 40 on narrow sides 18 are folded inward the resulting connection to the edges 14 of the tanks 12 is improved. Rigidity of the narrow sides 18 is increased by the bonding of the edges 14 of the tank 12.

FIGS. 6–10 illustrate steps that may be taken to manufacture the tubes 16. As best seen in FIGS. 6A and 7A, the tube end 22 may begin with a rectangular cross section having rounded corners 41 between the narrow sides 18 and the broad sides 20. If this is the case, it is preferred that the corners be formed more sharply by inserting a tool (not shown) into the end 22 to form a rectangular cross section having sharp corners 41, as seen in FIGS. 6B, 7B and 7C. A shoulder 42 is formed in the tube 16 as a byproduct of the insertion of the tool. The rectangular cross section creates more favorable conditions for bonding the narrow sides 18 to the side walls 14 of the tank 12 tightly and permanently. Next, as best seen in FIG. 6C, the narrow side 18 of each end 22 of the flat tubes 16 are cut, off-center, at 43 to separate the tube into a pair of broad sides 20*a*, 20*b* and form tabs 40 from the narrow sides 18. As seen in FIGS. 6D and 6E, the broad sides 20*a*, 20*b* are bent to form right angle bends 28 relative to the longitudinal axis 29 of the flat tube 16. The end 32 is formed by remounting or reshaping a section of each of the narrow sides 18, as seen in FIG. 6F. As seen in FIG. 6G, each broad side 20*a*, 20*b* is bent a second time to form a second right angle bend 28 that positions a portion of the broad side 20*a*, 20*b* generally parallel to the longitudinal axis 29 of the flat tube 16. As seen in FIG. 6H, the tabs 40 are preferably folded inside the tube 16 against the narrow sides 18. The cutting and deformation of the flat tube ends 22 may be carried out with a deformation machine equipped with a progressive die in which a finished deformed flat tube 16 is ejected with each stroke.

As shown in FIGS. 9A–9E, after the cuts 43 are formed, the separated broad sides 20*a*, 20*b* may alternatively be bent into a semi-circle 44 or semi-ellipse with ends 32 that are bent into a generally perpendicular orientation to the longitudinal axis 29 of the flat tube 16. As with the embodiment of FIGS. 6A–H, a section of each of the narrow sides 18 may be removed or reshaped to form the end 32. The tab 40 is preferably folded and bent inside the flat tube 16, as seen in FIG. 9E. As seen in FIG. 10, the narrowed ends 32 are abutted to the ends 32 of any adjacent flat tubes 16 to form the fluid barrier with the corresponding tank 12. A wavy surface 25 is formed by the abutting of the ends 32 of the tubes 16 in this manner.

Figure 12:
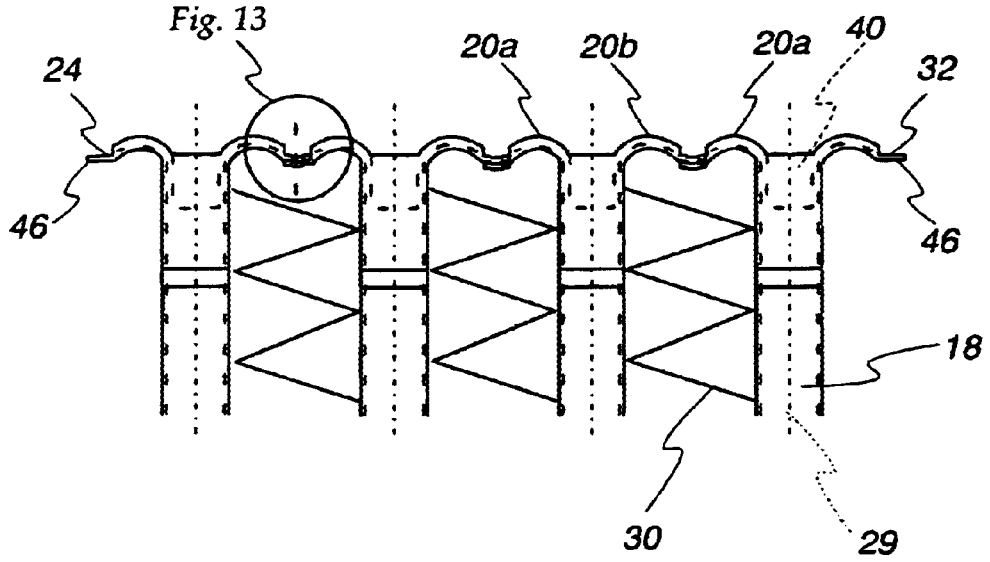
FIG. 12 is a side elevation of a row of bonded flat tubes according to an embodiment of the invention.
Figure 13:
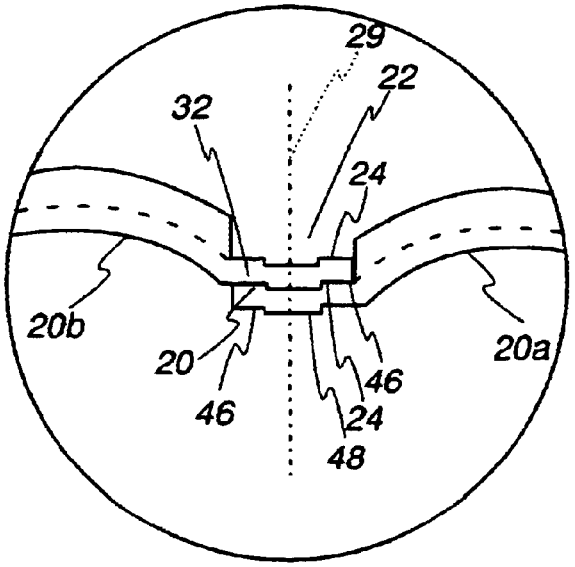
FIG. 13 is an enlarged view taken from line X in FIG. 12.

Rather than being bent into a generally parallel orientation relative to the longitudinal axis 29 of the flat tubes 16, the ends 32 may be retained in a generally perpendicular orientation relative to the longitudinal axis 29 of the flat tubes 16, as seen in FIG. 12. In that case, the ends 32 of adjacent flat tubes 16 are arranged one on top of the other with an exposed inner surface 24 bonded to an exposed outer surface 46 of any adjacent tube 16. Optionally, a prefixation 48 can be formed in the narrowed end 32, as shown in FIG. 13 to impart temporary holding of the tubes 16 before assembly with the tanks 12 and bonding of the assembled heat exchanger. The prefixation 48 is produced with a tool (not shown) that partially interlaces the adjacent ends 32. The prefixation may also be introduced by other means. The previously described embodiments may also include such prefixation.

Figure 14:
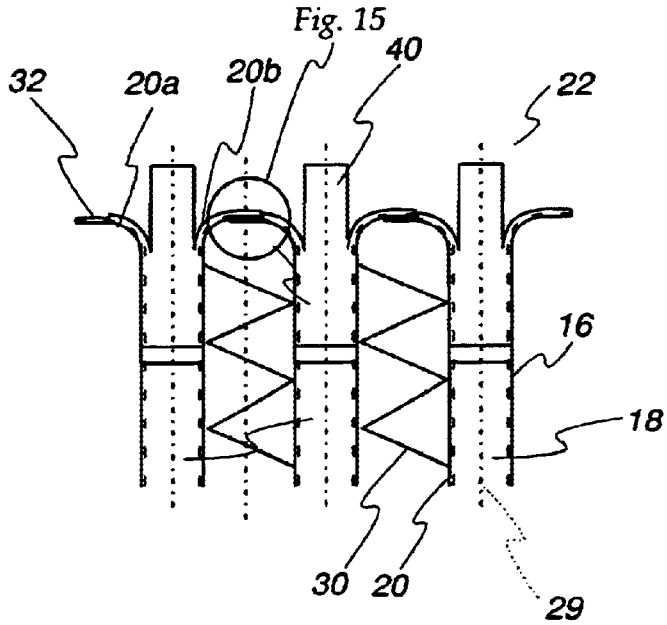
FIG. 14 is a side elevation of a row of bonded flat tubes according to an embodiment of the invention.
Figure 15:
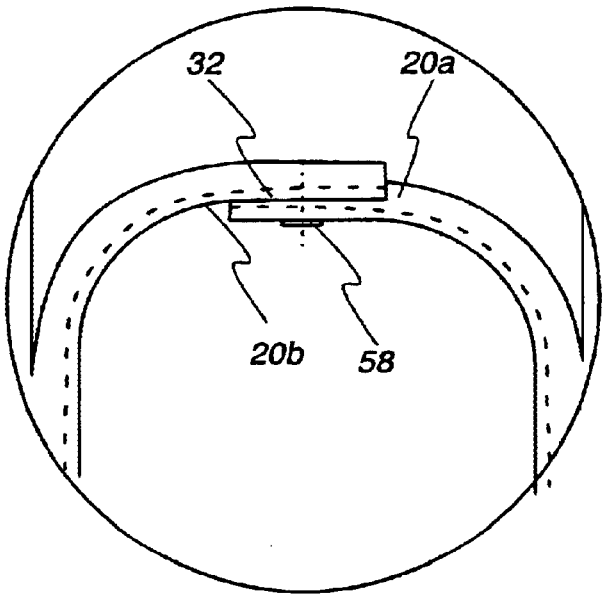
FIG. 15 is an enlarged view taken from line X in FIG. 14.

Alternatively, as seen in FIG. 14, rather than removing a section from the narrow sides 18 of both sides 20*a*, 20*b*, a section of the narrow sides 18 of only one broad side 20*a* are removed or reshaped to form the end 32 while the opposite broad side 20*b* remains intact. The end 32 of the broad side 20*a* is placed under the intact broad side 20*b* of an adjacent flat tube 16 and a prefixation 58 is preferably formed in the abutted broad sides 20*a*, 20*b* as best seen in FIG. 15.

Figure 16:
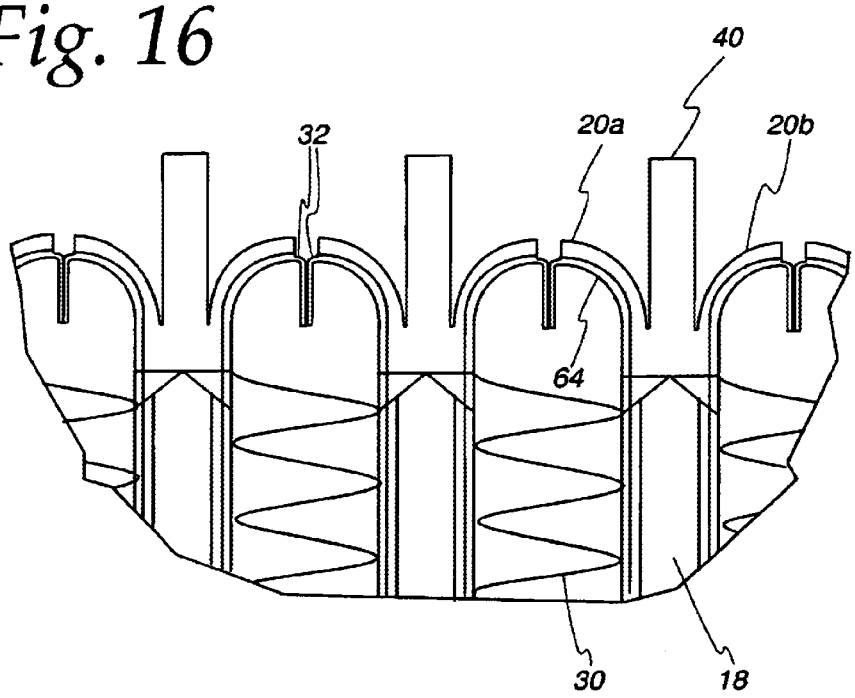
FIG. 16 shows a partial section of a row of bonded flat tubes according to an embodiment of the invention.
Figure 17:
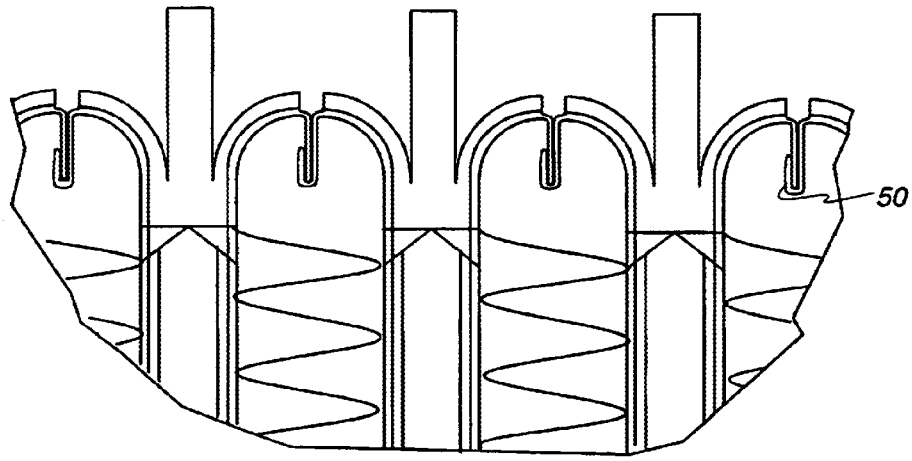
FIG. 17 shows a modification of the embodiment depicted in FIG. 16.

Further examples of the tubes 16 are depicted in FIGS. 16 and 17. The cut away broad sides 20*a*, 20*b* are bent so as to generally form a semi-circle 64 when one end 32 is abutted to an adjacent end 32, resulting in a wavy surface 25, rather than a flat surface 25 as in FIGS. 3 and 4. Optionally, one or both of the abutting ends 32 may be further bent, for example into the bend 50 depicted in FIG. 17, to improve the bonding connection between the flat tubes 16. The bend 50 serves as a prefixation.

Figure 8A:
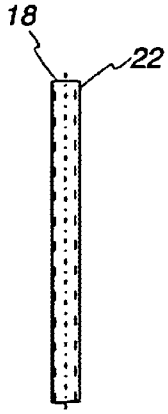
FIGS. 8A–8E are schematic depictions of another flat tube end deformation process.
Figure 8B:
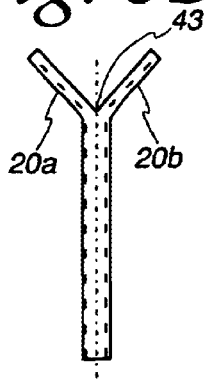
Figure 8C:
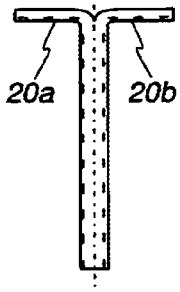
Figure 8D:
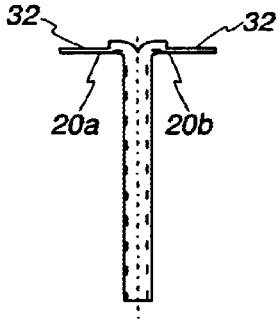
Figure 8E:
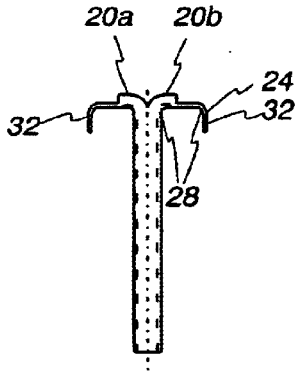

An alternative process for manufacturing the tubes 16 is depicted in FIGS. 8A–8E. The narrow sides 18 of each of the ends 22 of the flat tubes 16 are cut centrally at 41 to separate each end 22 into the broad sides 20*a*, 20*b*, as seen in FIG. 8B. As seen in FIG. 8C, the broad sides 20*a*, 20*b* are bent to form right angle bends 28 relative to the longitudinal axis 29 of the flat tube 16. A section of each of the narrow sides 18 is removed or reshaped forming the thin end 32. As seen in FIG. 8E, each of the broad sides 20*a*, 20*b* is bent a second time to form a second right angle bend 28 that positions a portion of the broad side 20*a*, 20*b* generally parallel to the longitudinal axis 29 of the flat tube 16.

The flat tubes 16 can be used in a variety of heat exchangers, for example in coolant coolers or air-cooled charge coolers with, for example, the embodiment of FIG. 6 being preferred for air-cooled charge coolers and the embodiment of FIG. 8 being preferred for coolant coolers.

Once the ends 22 of the flat tubes 16 have been deformed, the flat tubes 16 are bonded to one another and bonded to the tanks 12. In a preferred embodiment, the entire heat exchanger including the tubes 16, fins 30, and tanks 12 are produced from solder-coated aluminum sheet. The resulting fluid barrier with the tanks 12 has either an almost flat surface 25 or a wavy surface 25 facing the collection tank 12, which can provide reduced pressure losses over configurations currently known. The connection between the broad sides 20 should extend the entire width of the broad side 20. The flat tube ends 22 are generally rectangular and therefore the broad sides 20 do not taper along the end 22 in the direction of the cut 41. The rectangular shape eliminates any pressure loss from such tapering.

Another manufacturing method according to the invention for heat exchangers 10 with flat tubes 16 made of half shells is conducted by deforming the ends 22 of the half shells of the flat tubes 16 prior to assembling the fins 30 and the opposite half shell. The half shells are bonded to form flat tubes 16 during the same process that bonds the rows of fins 30 to the flat tubes 16 and bonds the exposed inner surfaces 24 of the deformed half shells to one another.

The use of any and all examples, or exemplary language (e.g., "such as" or "for example") provided herein, is intended merely to better illuminate the invention and does not pose a limitation on the scope of the invention unless expressly recited in a claim.

While some potential advantages and objects have been expressly identified herein, it should be understood that some embodiments of the invention may not provide all, or any, of the expressly identified advantages and objects.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A heat exchanger comprising:

a pair of tanks spaced opposite each other, and a plurality of spaced apart flat tubes to provide flow paths between the tanks;

each flat tube having opposing ends corresponding to one of the tanks, each end having a first broad side, a second broad side, and two narrow sides, each broad side having an inner surface and an outer surface;

each first broad side being deformed to expose the inner surface of the first broad side; and each of the exposed inner surfaces of each first broad side is bonded to the outer surface of any adjacent second broad side to define a fluid barrier with the corresponding tank; and each of the bonded first and second broad sides are curved to expose the inner surface with a cross-section that is semicircular or semielliptical.

2. A heat exchanger comprising:

a pair of tanks spaced opposite each other, and a plurality of spaced apart flat tubes to provide flow paths between the tanks;

each flat tube having opposing ends corresponding to one of the tanks, each end having a first broad side, a second broad side, and two narrow sides, each broad side having an inner surface and an outer surface;

each first broad side being deformed to expose the inner surface of the first broad side; and each of the exposed inner surfaces of each first broad side is bonded to the outer surface of any adjacent second broad side to define a fluid barrier with the corresponding tank; and the each of the narrow sides of each flat tube include two cuts therein, the cuts separating the broad sides of tube ends and defining a tab in each narrow side.

3. The heat exchanger of claim 2 wherein the tabs are bent inward into the flat tube.

4. A heat exchanger, comprising:

a pair of collection tanks spaced opposite each other; and a plurality of spaced apart flat tubes to provide flow paths between the tanks;

each flat tube having opposing ends corresponding to one of the tanks, each end having two broad sides and two narrow sides;

each broad side having an inner surface deformed to expose the inner surface of the broad side;

each of the exposed inner surfaces of each flat tube being bonded to the exposed inner surface of any adjacent flat tube to define a fluid barrier with the corresponding tank.

5. The heat exchanger of claim 4 wherein each of the narrow sides is connected to an edge of the corresponding tank.

6. The heat exchanger of claim 4 wherein each of the deformed broad sides of the flat tube ends has two bends of about 90°, with the bonded inner surface arranged in parallel orientation to the broad sides of any adjacent flat tube.

7. The heat exchanger of claim 4 wherein the bonded inner surfaces of the flat tubes are arranged in oblique orientation relative to a longitudinal axis of the flat tubes, and the broad sides have a first bend of about 90° and a second bend corresponding to the angle of the oblique orientation.

8. The heat exchanger of claim 4 wherein each of the deformed broad sides is curved to expose the inner surface with a cross-section that is semicircular or semielliptical.

9. The heat exchanger of claim 4 wherein the bonded broad sides of the flat tubes define a plurality of fluid inflow funnels to the flat tubes.

10. The heat exchanger of claim 4 wherein the flat tubes are formed from two half-shells.

11. The heat exchanger of claim 4 wherein each of the narrow sides includes a cut therein extending parallel to a longitudinal axis of the flat tube, the cut separating the broad sides at the tube end.

12. The heat exchanger of claim 4 wherein each of the narrow sides includes two cuts therein, the cuts separating the broad sides at the tube ends and defining a tab in each of the narrow sides.

13. The heat exchanger of claim 12 wherein the tabs are bent inward into the flat tube.

14. A method for manufacturing a heat exchanger, the method comprising the steps of:

cutting a plurality of flat tube ends to separate each tube end into a pair of broad sides;

deforming each of the broad sides to expose an inner surface of the broad side;

abutting the exposed inner surface of each of the broad sides to an exposed inner surface of an adjacent broad side of another tube;

affixing a tank on the flat tube ends; and bonding the adjacent broad sides to each other and the flat tube ends to the tanks.

15. The method of claim 14 wherein each flat tube end includes a pair of narrow sides; and wherein the bonding step includes bonding the narrow sides of the flat tube ends to the tank.

16. A method for manufacturing a heat exchanger, the method comprising the steps of:

cutting a plurality of flat tube ends to separate each tube end into a pair of broad sides;

deforming each of the broad sides to expose an inner surface of the broad side;

abutting the exposed inner surface of one of the broad sides to an outer surface of an adjacent broad side;

affixing a tank on the flat tube ends; and bonding the adjacent broad sides to each other and the flat tubes with the tanks.

17. The method of claim 16 wherein each flat tube end includes a pair of narrow sides; and wherein the bonding step includes bonding the narrow ends of the flat tube ends to the tank.

* * * * *